US008113863B2

(12) United States Patent
Vrenna et al.

(10) Patent No.: US 8,113,863 B2
(45) Date of Patent: Feb. 14, 2012

(54) SOCKET CONNECTOR HAVING A THERMALLY CONDUCTIVE INSERT

(75) Inventors: Jason Edward Vrenna, Angola, NY (US); James Albert Leidy, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/547,099

(22) Filed: Aug. 25, 2009

(65) Prior Publication Data

US 2011/0053391 A1 Mar. 3, 2011

(51) Int. Cl.
*H01R 13/62* (2006.01)

(52) U.S. Cl. ..... 439/327; 439/630; 439/932

(58) Field of Classification Search ..... 439/327, 439/630

See application file for complete search history.

(56) References Cited

U.S. PATENT DOCUMENTS

| | | | | |
|---|---|---|---|---|
| 3,651,444 | A * | 3/1972 | Desso et al. | 439/141 |
| 4,542,784 | A * | 9/1985 | Welsh | 165/80.4 |
| 5,387,115 | A * | 2/1995 | Kozel et al. | 439/157 |
| 6,529,386 | B2 * | 3/2003 | Boe | 361/801 |
| 7,371,097 | B1 * | 5/2008 | Pennypacker et al. | 439/327 |
| 7,651,366 | B2 * | 1/2010 | Ringler et al. | 439/513 |
| 2007/0212906 | A1 * | 9/2007 | Clayton et al. | 439/77 |

* cited by examiner

*Primary Examiner* — Hien Vu

(57) ABSTRACT

A socket connector includes a housing having a mating end and a mounting end. The housing has a receptacle at the mating end configured to receive an electronic module therein. The mounting end of the housing is configured to be mounted to a circuit board. Contacts are held by the housing. The contacts have mating ends exposed within the receptacle for mating with the electronic module. The contacts having mounting ends extending from the housing for terminating to the circuit board. A thermally conductive insert is held by the housing and is configured to be in thermal engagement with the circuit board and the insert has a module engagement interface configured to be in thermal engagement with the electronic module such that the insert transfers heat from the electronic module to the circuit board.

20 Claims, 4 Drawing Sheets

SOCKET CONNECTOR HAVING A THERMALLY CONDUCTIVE INSERT

BACKGROUND OF THE INVENTION

The subject matter herein relates generally to socket connectors, and more particularly, thermal management of socket connectors.

Computers and servers may use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), or the newer Dual In-line Memory Modules (DIMM's), Small Outline DIMM's (SODIMM's), and Fully Buffered DIMM's. Typically, the electronic modules are installed in one or more multi-pin socket connectors mounted on a system board or motherboard. Each electronic module has a card edge that provides an interface generally between two opposite rows of contacts in the socket connector.

There is an ongoing trend toward smaller electronic packages. The space provided for electronic modules and socket connectors is limited. Moreover, the amount of electrical power consumed by electronic modules, and thus the amount of electrical power carried by the socket connectors, is increasing. Accordingly, more of the contacts of the socket connectors are being used to carry electrical power. The contacts carrying the electrical power generate heat. Additionally, the components held by the electronic modules generate heat. Problems arise in attempting to dissipate the heat generated by the contacts of the socket connector as well as by the electronic modules themselves. Typically, heat sinks are coupled to one or both sides of the electronic modules above the socket connectors. The heat sinks extend outward from the electronic modules, taking up room around the electronic modules. The trend toward smaller electronic packages tends to reduce the amount of space around the electronic modules by populating the space with other socket connectors and corresponding electronic modules, or with other components mounted to the motherboard or as part of the system in general.

There is a need for a device that improves heat dissipation from electronic modules without increasing overall package size.

BRIEF DESCRIPTION OF THE INVENTION

In one embodiment, a socket connector is provided that includes a housing having a mating end and a mounting end. The housing has a receptacle at the mating end configured to receive an electronic module therein. The mounting end of the housing is configured to be mounted to a circuit board. Contacts are held by the housing. The contacts have mating ends exposed within the receptacle for mating with the electronic module. The contacts having mounting ends extending from the housing for terminating to the circuit board. A thermally conductive insert is held by the housing and is configured to be in thermal engagement with the circuit board and the insert has a module engagement interface configured to be in thermal engagement with the electronic module such that the insert transfers heat from the electronic module to the circuit board.

In another embodiment, a socket connector is provided including a housing mountable to a host circuit board holding contacts mateable to an electronic module configured to be coupled to the housing. The electronic module includes a circuit board with an edge of the circuit board being received in the housing. A thermally conductive insert is held by the housing in thermal engagement with the electronic module. The insert extends from the housing and is configured to be coupled to the host circuit board. The insert is configured to dissipate heat from the electronic module to the host circuit board.

In a further embodiment, a socket connector is provided that includes a housing having a mating end and a mounting end. The housing has a receptacle at the mating end configured to receive an electronic module therein. The mounting end of the housing is configured to be mounted to a circuit board. Contacts are held by the housing for mating with the electronic module. A thermally conductive insert is held by the housing. The insert is configured to be in thermal engagement with the electronic module and with the circuit board to transfer heat from the electronic module to the circuit board. A spring clip is coupled to the housing. The spring clip is configured to engage the electronic module to bias the electronic module against the insert.

DETAILED DESCRIPTION OF THE INVENTION

Figure 1:
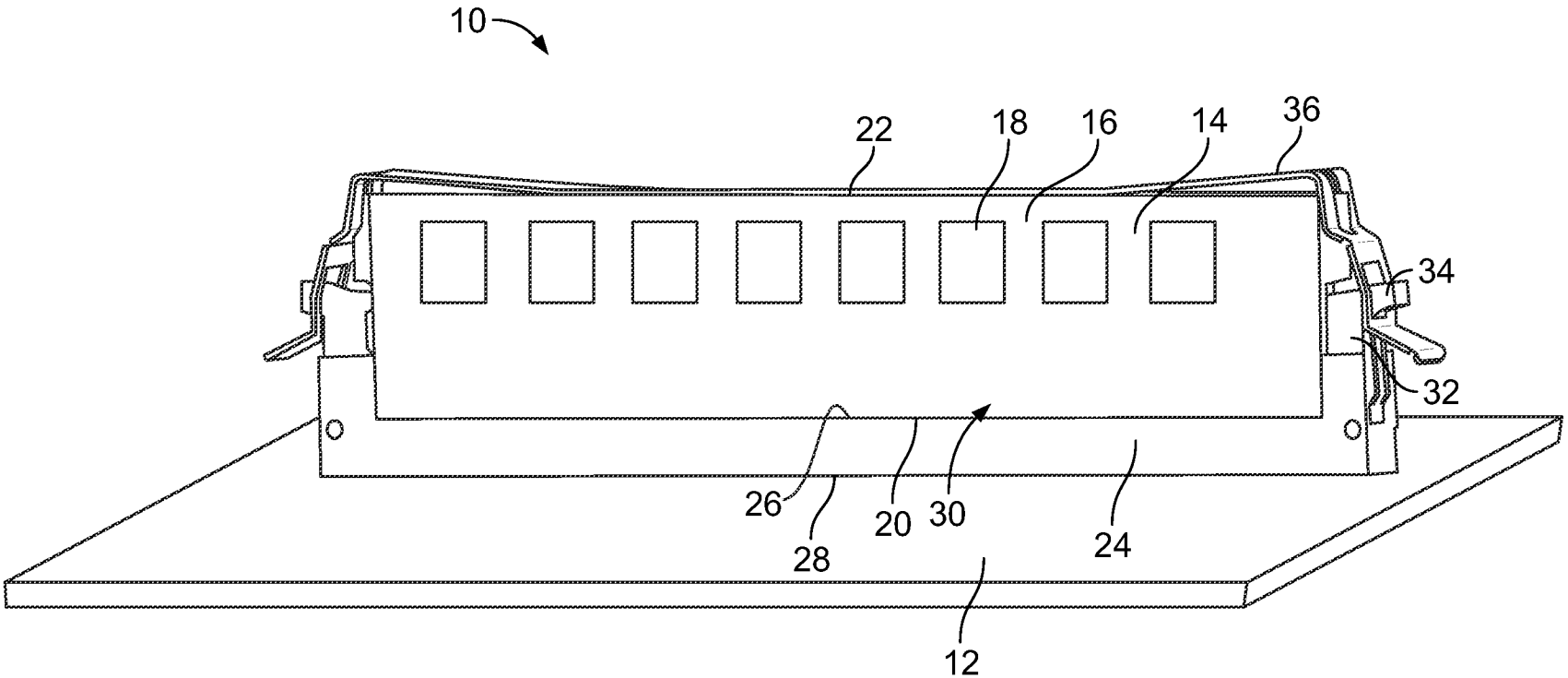
FIG. 1 is a side perspective view of a socket connector formed in accordance with an exemplary embodiment.

FIG. 1 is a side perspective view of a socket connector 10 formed in accordance with an exemplary embodiment. The socket connector 10 is mounted to a circuit board 12. An electronic module 14 is coupled to the socket connector 10. The socket connector 10 interconnects the electronic module 14 with the circuit board 12. In the illustrative embodiment, the circuit board 12 represents a host board or a motherboard forming part of an electrical system or device, such as a computer, a server, a network switch, and the like. The electronic module 14 represents a memory module and the socket connector 10 represents a Dual In-line Memory Module (DIMM) socket, however, other types of electronic modules and/or socket connectors may be provided in alternative embodiments.

The electronic module 14 includes a circuit board 16 that is mated with the socket connector 10. For example, an edge of the circuit board 16 is plugged into the socket connector 10. Memory devices 18 are mounted to one or both sides of the circuit board 16. Optionally, the memory devices 18 may be integrated circuit (IC) components, such as microchips or microprocessors, mounted to the circuit board 16. The electronic module 14 includes a mating end 20 and an outer end 22 opposite to the mating end 20. The mating end 20 is loaded into the socket connector 10 such that the circuit board 16 is perpendicular to the circuit board 12. Alternatively, the electronic module 14 may be coupled to a different type of socket connector such that the circuit board 16 is parallel to, and spaced apart from, the circuit board 12. Other configurations are possible as well that orient the electronic module at an angle other than perpendicular or parallel to the circuit board 16.

The socket connector 10 includes a housing 24 mounted to the circuit board 12. The housing 24 includes a mating end 26 and a mounting end 28. The mounting end 28 rests on the circuit board 12. A receptacle 30 is provided at the mating end 26 to receive the memory device 18. Optionally, the receptacle 30 may constitute a card edge slot. In an exemplary embodiment, the mating end 26 and the mounting end 28 are opposite to one another. Alternatively, the mating end 26 may be angled with respect to the mounting end 28, such as perpendicular to the mounting end 28 defining a right angle socket connector or at other angles, to receive the electronic module 14.

Ejectors 32 are provided at opposite ends of the housing 24. The ejectors 32 hold the electronic module 14 within the socket connector 10. The ejectors 32 are used to eject the electronic module 14 from the receptacle 30. In an exemplary embodiment, each ejector 32 includes a tab 34 extending therefrom.

In an exemplary embodiment, the socket connector 10 includes a spring clip 36 coupled to the housing 24. Optionally, the spring clip 36 may be coupled to the ejectors 32. The spring clip 36 extends along the outer end 22 of the electronic module 14. The spring clip 36 is biased against the electronic module 14 to force the electronic module 14 into the receptacle 30. Optionally, the spring clip 36 may be bowed such that a central portion of the spring clip 36 engages electronic module 14. The spring clip 36 may be flexed when coupled to the housing 24 and the electronic module 14 to provide a spring force against the electronic module 14. The spring clip 36 may have alternative shapes in alternative embodiments. The spring clip 36 may engage different portions of the electronic module 14 in alternative embodiments. The spring clip 36 may be coupled to different portions of the housing 24 or other structures, such as the circuit board 12, in alternative embodiments. Multiple spring clips may be provided. Other types of biasing mechanisms, generally referred to as spring clips, may be used in alternative embodiments to provide a normal force on the electronic module 14.

Figure 2:
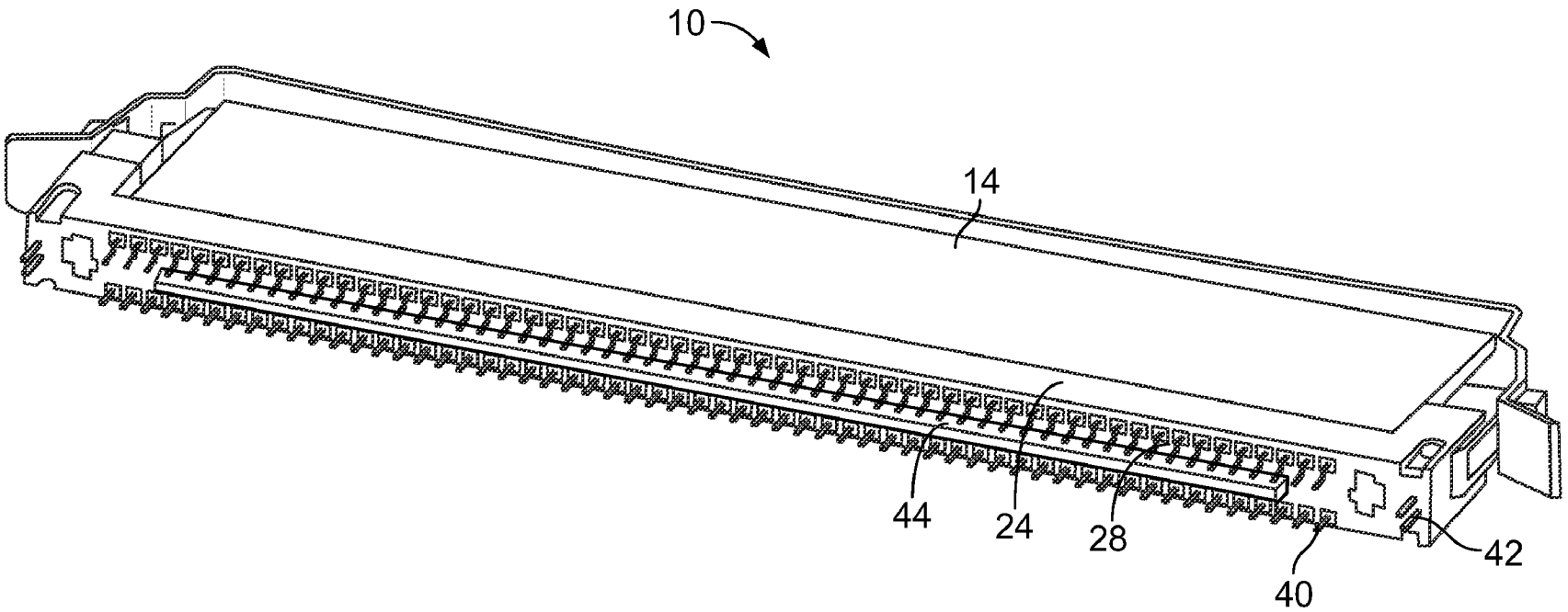
FIG. 2 is a bottom perspective view of the socket connector shown in FIG. 1.

FIG. 2 is a bottom perspective view of the socket connector 10 with the electronic module 14 coupled thereto. The mounting end 28 of the housing 24 is illustrated. The socket connector 10 includes a plurality of contacts 40 held by the housing 24 that extend from the mounting end 28 for mating with the circuit board 12 (shown in FIG. 1). For example, the contacts 40 may be through hole mounted to corresponding vias in the circuit board 12. Alternatively, the contacts 40 may be surfaced mounted to pads on the circuit board 12 or may be a compliant pin press fit. In the illustrative embodiment, the contacts 40 are arranged in two parallel rows.

The socket connector 10 includes mounting clips 42 that hold the housing 24 to the circuit board 12. The mounting clips 42 may be used to orient the socket connector 10 in proper position with respect to the circuit board 12. Optionally, the mounting clips 42 may hold the housing 24 in position on the circuit board 12 during soldering of the socket connector 10 to the circuit board 12.

The socket connector 10 includes a seating plane in the form of an insert 44 extending from the mounting end 28 of the housing 24. The insert 44 is arranged between the rows of contacts 40. The insert 44 is used to help seat the socket connector 10 onto the circuit board 12. Optionally, the circuit board 12 may include a channel that receives the insert 44 therein to help stabilize the socket connector 10 with respect to the circuit board 12. In an exemplary embodiment, the insert 44 is thermally conductive and thermally engages the circuit board 12 to dissipate heat from the socket connector 10 to the circuit board 12. The insert 44 is also in thermal engagement with the electronic module 14 to dissipate heat from the electronic module 14 to the circuit board 12. The insert 44 defines a thermally conductive path from the electronic module 14 to the circuit board 12. In an exemplary embodiment, the insert 44 may be manufactured from a metal material. The insert 44 may be soldered to the circuit board 12 during a soldering operation, or may otherwise thermally engage the circuit board 12, such as by a thermal paste. The insert 44 may be manufactured from other highly thermally conductive materials such as plated plastic, thermally conductive plastic or other thermally conductive compounds with good thermal conductivity properties.

Figure 3:
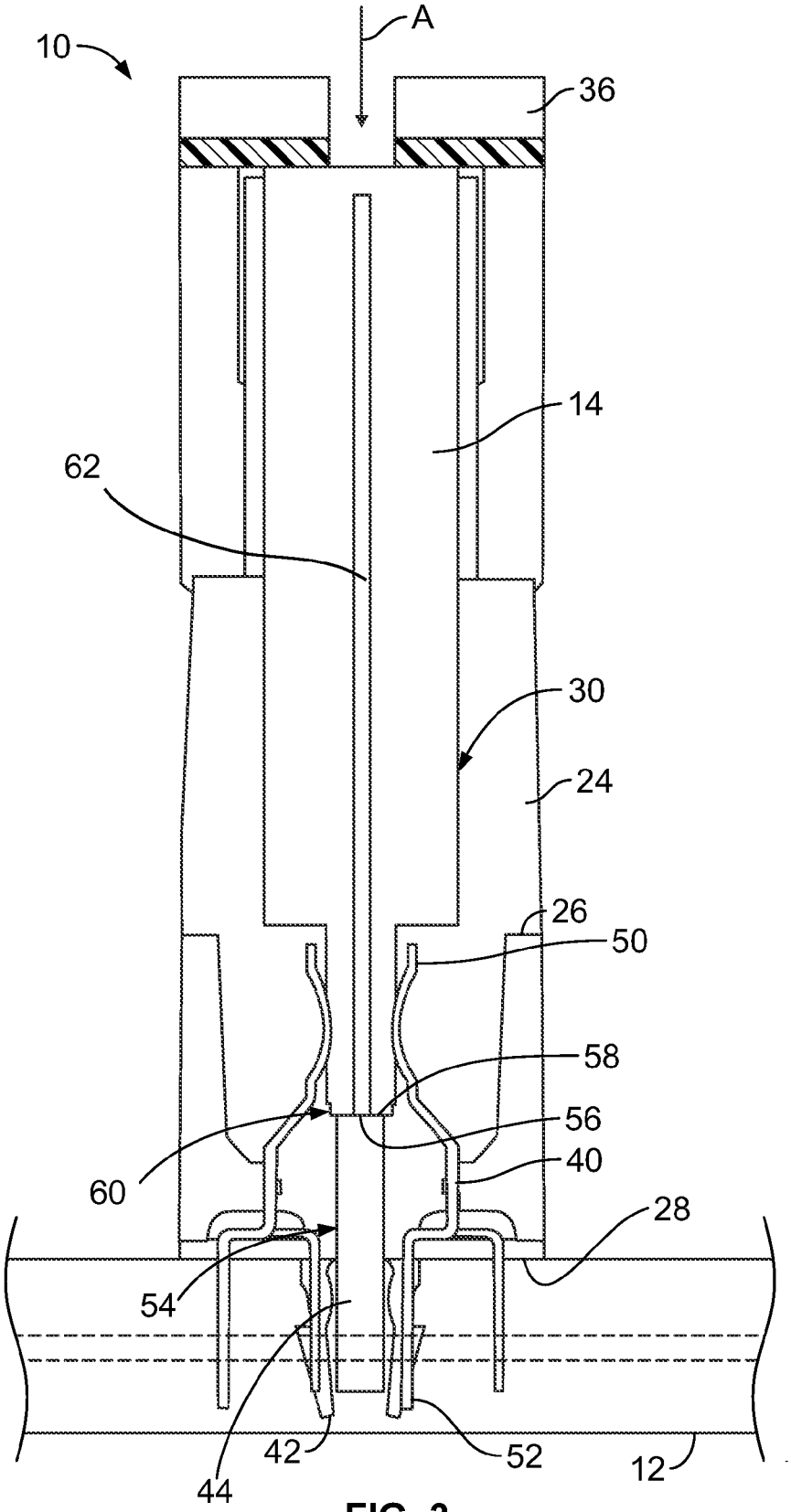
FIG. 3 is a cross-sectional view of the socket connector shown in FIG. 1.

FIG. 3 is a cross-sectional view of the socket connector 10 with the electronic module 14 coupled thereto. The socket connector 10 is mounted to the circuit board 12, which is represented schematically in FIG. 3. The mounting end 28 of the housing 24 rests upon the circuit board 12. The mating end 26 is opposite the mounting end 28 and is generally parallel to the mounting end 28. The electronic module 14 is loaded into the receptacle 30 through the mating end 26 of the housing 24.

The contacts 40 are held by the housing 24 and extend from the mounting end 28 into the circuit board 12. The contacts 40 extend between mating ends 50 and mounting ends 52. The contacts 40 are held by the housing 24 such that the mounting ends 52 extend from the housing 24 for electrical connection with the circuit board 12. The mating ends 50 are exposed within the receptacle 30 for mating with the electronic module 14. In an exemplary embodiment, the contacts 40 are arranged in two generally parallel rows configured to engage both sides of the electronic module 14. The mating portions of the contacts 40 proximate to the mating ends 50 are held against electronic module 14, such as by a spring force. For example, the contacts 40 may be deflected outward during mating with the electronic module 14 such that the contacts 40 are biased against the electronic module 14. The portions of the contacts 40 extending from the mounting end 28, sometimes referred to as contact tails, may be staggered along the centerline of each row. Such configuration may accommodate tighter spacing between the contacts 40.

The contacts 40 may be power contacts transmitting power across the mating the face, signal contacts transmitting data across the mating face, or ground contacts grounding the socket connector 10 to circuit board 12. In an exemplary embodiment, the socket connector 10 includes all three types of contacts.

The housing 24 includes a cavity 54 that is open at the mounting end 28 and that receives the insert 44. Optionally, the insert 44 may be loaded into the cavity 54 through the mounting end 28 and held in the cavity 54 by a press fit. Alternatively, the body of the housing 24 may be molded around a portion of the insert 44 such that a portion of the insert 44 is surrounded by the housing 24 and another portion of the insert 44 extends from the housing 24. The insert 44 is received within the circuit board 12 and is in thermal engagement with a portion of the circuit board 12. Optionally, the circuit board 12 may include a heat sink or one or more layers that define a heat sink, wherein heat transmitted by the insert 44 is dissipated from the insert 44 by the heat sink or the layers of the circuit board 12 defining a heat sink. The insert 44 includes a module engagement interface 56 that is in thermal engagement with the electronic module 14. The module engagement interface 56 may be planar and defined by the top of the insert 44. Alternatively, the module engagement interface 56 may be defined by more than one surface of the insert 44, such as the top and portions of the sides of the insert 44.

The insert 44 is manufactured from a thermally conductive material, such as a metal material like copper or bronze. The insert 44 may be manufactured from other types of materials that are thermally conductive. The insert 44 provides a direct link between electronic module 14 and circuit board 12 to dissipate heat from the electronic module 14 through the socket connector 10 and into the circuit board 12. For example, the insert 44 may be directly physically engaged to the electronic module 14 and to the circuit board 12. In this manner, the insert 44 defines a heat sink transferring heat away from the electronic module 14. The circuit board 12 provides a large area for dissipating the heat generated by the electronic module 14.

The socket connector 10 includes a contact reception cavity 60 between the contacts 40. The contact reception cavity 60 may be part of the receptacle 30. The edge of the electronic module 14 is received within the contact reception cavity 60. The contacts 40 engage contact pads on the outer sides of the edge of the electronic module 14 within the contact reception cavity 60. The contact reception cavity 60 is open to the cavity 54. At least a portion of the insert 44 is received within the contact reception cavity 60 between the two rows of contacts 40.

The socket connector 10 has an outer perimeter defining a footprint on the circuit board 12. Optionally, the outer perimeter may be the largest at the mounting end 28. In an exemplary embodiment, the insert 44 is positioned entirely within the outer perimeter of the socket connector 10 such that the overall footprint of the socket connector 10 is not increased by the insert 44.

When the electronic module 14 engages the insert 44, heat transfer is able to occur across the interface. Optionally, a thermally conductive paste 58 or other thermally conductive layer or material may be provided between the electronic module 14 and the module engagement interface 56 of the insert 44. The electronic module 14 may be specifically designed to transfer heat to the mating end 20 of the electronic module 14. For example, the electronic module 14 may include an internal heat sink 62, shown in phantom in FIG. 3, in the form of thermally conductive traces routed through the electronic module 14 to the mating end 20. Other configurations for the electronic module 14 are possible in alternative embodiments that transfer heat to the mating end 20.

In an exemplary embodiment, the spring clip 36 is provided to hold the electronic module 14 in the receptacle 30. The spring clip 36 generally forces the electronic module 14 toward the insert 44. For example, the spring clip 36 provides a normal force on the electronic module 14 in the direction of the insert 44, as shown by the arrow A. The pressure holding the electronic module 14 against the module engagement interface 56 provides good thermal contact between the electronic module 14 and the insert 44.

The mounting clip 42 is illustrated in FIG. 3. The mounting clip 42 is received within the circuit board 12 to hold the socket connector 10 in position with respect to the circuit board 12. In an exemplary embodiment, the mounting clip 42 extends further from the mounting end 28 of the housing 24 than the contacts 40 and/or the insert 44. The mounting clip 42 may thus be used to locate the socket connector 10 with respect to the circuit board 12 prior to loading the contacts 40 and/or the insert 44 into the corresponding vias and channel, respectively.

Figure 4:
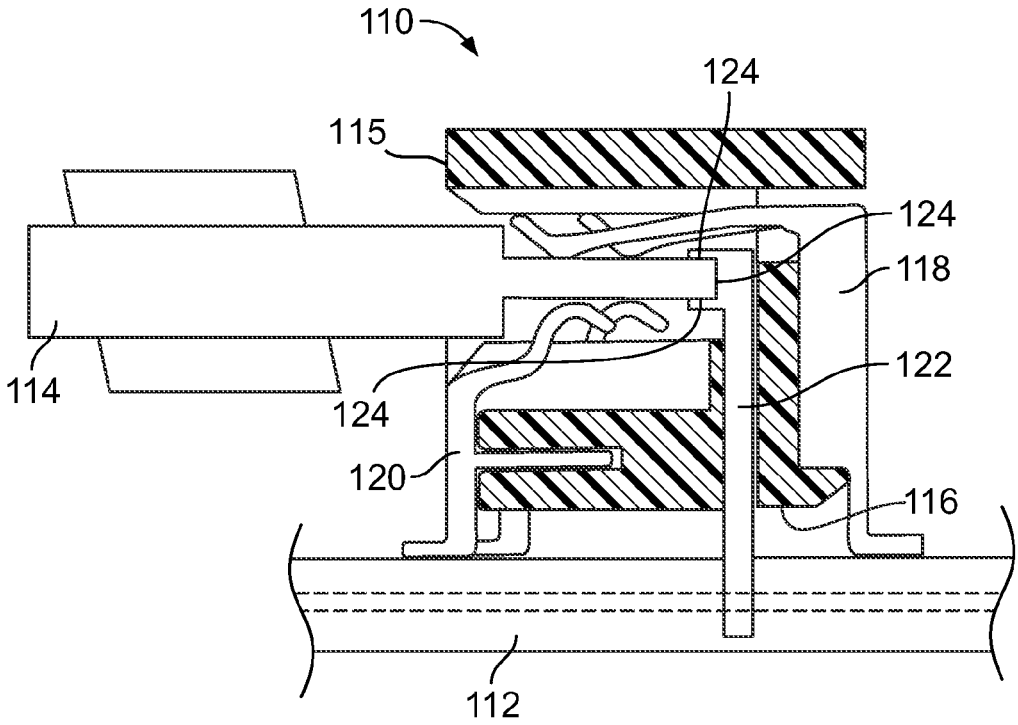
FIG. 4 is a cross-sectional view of an alternative socket connector.

FIG. 4 is a cross-sectional view of an alternative socket connector 110. The socket connector 110 is mounted to a circuit board 112. An electronic module 114 is received within the socket connector 110. The socket connector 110 represents a right angled socket connector having a mating end 115 oriented perpendicular to a mounting end 116. The electronic module 114 is loaded into the socket connector 110 in a direction parallel to the circuit board 112. Alternatively, the electronic module 114 may be loaded into the socket connector 110 at an angle that is non-parallel to the circuit board and then is rotated to an orientation that is parallel to the circuit board 112. The electronic module 114 is oriented generally parallel to the circuit board 112 and is spaced apart from the circuit board 112. Such configuration reduces the overall height of the system and is suited for applications in which a low-profile connector is utilized, such as for example, a notebook computer application.

The socket connector 110 includes upper contacts 118 and lower contacts 120 that engage an upper side and lower side, respectively of the electronic module 114. The upper and lower contacts 118, 120 are electrically connected to the circuit board 112. In the illustrated embodiment, the upper and lower contacts 118, 120 are surface mounted to the circuit board 112.

The socket connector 110 includes a thermally conductive insert 122. The insert 122 extends from the mounting end 116 and engages the circuit board 112. Optionally, the insert 122 extends at least partially through the circuit board 112. The insert 122 is in thermal communication with the circuit board 112 to transfer heat from the electronic module 114 into the circuit board 112. The insert 122 includes a module engagement interface 124 that engages the electronic module 114. Optionally, the module engagement interface 124 may engage multiple surfaces of the electronic module, such as an end and one or more sides of the electronic module 114. The insert 122 is in thermal engagement with electronic module 114 such that the insert 122 transfers heat away from the electronic module 114. The insert 122 provides a direct thermal link between electronic module 114 and the circuit board 112. In an exemplary embodiment, the insert 122 is manufactured from a thermally conductive material, such as a metal material. The insert 122 defines a heat sink the transfers heat from the electronic module 114 to the circuit board 112.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A socket connector comprising:

a housing having a mating end and a mounting end, the housing having a receptacle at the mating end configured to receive an electronic module therein, the mounting end of the housing being configured to be mounted to a circuit board;

contacts held by the housing, the contacts having mating ends exposed within the receptacle for mating with the electronic module, the contacts having mounting ends extending from the housing for terminating to the circuit board; and a thermally conductive insert held by the housing, the insert being positioned to thermally engage the circuit board when the housing is mounted to the circuit board, the insert having a module engagement interface positioned to thermally engage the electronic module when the electronic module is loaded into the receptacle, wherein the insert transfers heat from the electronic module to the circuit board, wherein the insert extends from the mounting end of the housing and is configured to extend into the circuit board to physically engage the circuit board to dissipate heat into the circuit board.

2. The socket connector of claim 1, wherein the insert is metal and is configured to directly engage the circuit board and the electronic module to transfer heat away from the electronic module to the circuit board.

3. The socket connector of claim 1, wherein the housing includes a cavity open at the mounting end of the housing, the insert being loaded into the cavity through the mounting end and held in the cavity by a press fit.

4. The socket connector of claim 1, wherein the insert includes a metal body, the housing being molded around the insert, a portion of the insert extending from the housing and another portion of the insert being surrounded by the housing.

5. The socket connector of claim 1, wherein the contacts are arranged within the housing in two parallel rows, the insert being positioned between the two rows of contacts.

6. The socket connector of claim 1, further comprising a spring clip coupled to the housing, the spring clip being configured to engage the electronic module to bias the electronic module against the insert.

7. The socket connector of claim 1, further comprising a thermally conductive paste on the module mating interface, the thermally conductive paste creating a thermal bond between the insert and the electronic module.

8. The socket connector of claim 1, wherein the housing has an outer perimeter defining a footprint on the circuit board, the insert being arranged within the outer perimeter such that the overall size of the footprint is unaffected by the insert.

9. A socket connector comprising:

a housing mountable to a host circuit board, the housing holding contacts arranged in two rows, the contacts being matable to an electronic module configured to be coupled to the housing, the electronic module including a circuit board with an edge of the circuit board being positioned between the rows of contacts when received in the housing; and a thermally conductive insert held by the housing between the rows of contacts, the insert thermally engaging the electronic module when the electronic module is received within the housing, the insert extending from the housing and engaging the host circuit board when the housing is mounted to the host circuit board, the insert dissipating heat from the electronic module to the host circuit board, wherein the insert is planar and includes a module engagement interface at an end of the insert, the module engagement interface physically engaging the edge of the circuit board of the electronic module, the insert being held within the housing such that the module engagement interface is positioned between the rows of contacts.

10. The socket connector of claim 9, wherein the insert extends into the host circuit board, the insert being in thermal engagement with a heat sink plane of the host circuit board to dissipate heat to the heat sink plane.

11. The socket connector of claim 9, wherein the insert physically engages the electronic module and the host circuit board to define a direct thermal link therebetween.

12. The socket connector of claim 9, wherein the housing includes a contact reception cavity between the rows of contacts, the contact reception cavity receives the edge of the circuit board of the electronic module therein, the insert engaging the circuit board of the electronic module proximate to the contact reception cavity.

13. The socket connector of claim 9, further comprising a spring clip coupled to the housing, the spring clip being configured to engage the electronic module to bias the electronic module against the insert.

14. A socket connector comprising:

a housing having a mating end and a mounting end, the housing having a receptacle at the mating end configured to receive an electronic module therein, the electronic module being planar and including a card edge received in the receptacle, the mounting end of the housing being configured to be mounted to a circuit board;

contacts held by the housing for mating with the electronic module;

a thermally conductive insert held by the housing, the insert being planar and aligned parallel to the electronic module, an end of the insert being configured to engage the card edge of the electronic module at a thermal interface, the insert being configured to be in thermal engagement with the electronic module and with the circuit board to transfer heat from the electronic module to the circuit board; and a spring clip coupled to the housing, the spring clip being configured to engage the electronic module to bias the electronic module against the insert.

15. The socket connector of claim 14, wherein the housing includes an ejector configured to eject the electronic module from the housing, the spring clip being coupled to the ejector.

16. The socket connector of claim 14, wherein the spring clip provides a biasing force on the electronic module in the direction of the mounting end of the housing.

17. The socket connector of claim 14, wherein an amount of thermal transfer between the insert and the electronic module is increased when the spring clip engages the electronic module.

18. The socket connector of claim 14, wherein the insert extends from the mounting end of the housing and is configured to extend into the circuit board to physically engage the circuit board to dissipate heat into the circuit board.

19. The socket connector of claim 14, wherein the housing includes a cavity open at the mounting end of the housing, the insert being loaded into the cavity through the mounting end and held in the cavity by a press fit.

20. The socket connector of claim 1, the electronic module being planar and including a card edge received in the receptacle, wherein the insert is planar and aligned parallel to the electronic module, the module engagement interface of the insert being configured to engage the card edge of the electronic module at a thermal interface.

* * * * *